US006211844B1

(12) United States Patent
Davi et al.

(10) Patent No.: US 6,211,844 B1
(45) Date of Patent: Apr. 3, 2001

(54) DUAL LNB/ANTENNA MULTI-SWITCH WITH DC PATH FOR THE TERRESTRIAL TELEVISION ANTENNA PORT

(75) Inventors: Leonard A. Davi, Lake Mary; Harvey Gilbert, Altamonte Springs, both of FL (US)

(73) Assignee: Recoton Corporation, Lake Mary, FL (US)

( * ) Notice: Subject to any disclaimer, the term of this patent is extended or adjusted under 35 U.S.C. 154(b) by 0 days.

(21) Appl. No.: 09/226,582

(22) Filed: Jan. 7, 1999

(51) Int. Cl.[7] ..... H01Q 3/24
(52) U.S. Cl. ..... 343/876; 343/840; 455/277.1
(58) Field of Search ..... 343/876, 840, 343/853; 455/3.2, 277.1; 348/725, 726

(56) References Cited

U.S. PATENT DOCUMENTS 5,774,194 * 6/1998 Armbruster ..... 348/726
6,038,594 * 3/2000 Puente et al. ..... 709/217

* cited by examiner

*Primary Examiner*—Tan Ho
(74) *Attorney, Agent, or Firm*—Levisohn, Lerner, Berger & Langsam

(57) ABSTRACT

A dual LNB/TV antenna multi-switch allowing DC voltage provided by a satellite receiver to travel through the terrestrial antenna input without causing interference, distortion or lowering the signal strength of the satellite and terrestrial antenna pictures. By including an external DC block adapter with the invention, the multi-switch can be used with both amplified and non-amplified antennas and not require an external power injector.

12 Claims, 2 Drawing Sheets

DUAL LNB/ANTENNA MULTI-SWITCH WITH DC PATH FOR THE TERRESTRIAL TELEVISION ANTENNA PORT

FIELD OF THE INVENTION

The present invention relates to satellite mini-dish multi-switches. More specifically, the invention is related to a Dual Low Noise Block and antenna multi-switch with a DC path for the terrestrial antenna port.

BACKGROUND OF THE INVENTION

Satellite mini-dish multi-switches have been available since the introduction of Dual Low Noise Block (LNB) mini-dish systems. An LNB receives a 10 GHz signal from an orbiting satellite and converts that signal down to 950–1450 MHz for reception by the mini-dish receiver. A dual LNB mini-dish system allows consumers with several receivers to receive multiple satellite signals in their home. The primary function of the multi-switch is to allow a dual LNB digital satellite mini-dish system's signal to be distributed to multiple mini-dish receivers, typically four or eight.

There are many multi-switches in the marketplace today. There are multi-switches with inputs for the A and B-side of a dual LNB system with four or eight outputs. There are multi-switches that also incorporate an outdoor VHF/UHF terrestrial antenna input for distribution to the same four or eight outputs. Amplified multi-switches, like the subject of the present invention, amplify the satellite signals and are necessary to compensate for splitter loses.

The basic function of a multi-switch is as follows. The multi-switch has an A input side rated at 13V/14V DC and a B input side rated at 17V/18V DC. Every time that a channel is changed, the satellite receiver sends either 13 or 17 volts up the coaxial cable to the multi-switch. The multi-switch detects which voltage is sent by means of a sensor and selects the appropriate LNB. The LNB routes the appropriate signal to the designated receiver. A multi-switch with antenna input will also combine the lower 50–800 MHz terrestrial antenna signals with the satellite signal for use with a single coaxial cable. It is then separated at the receiver by the use of a satellite diplexer.

All current satellite multi-switches allow DC voltage to travel up to the A and B inputs for power. However, DC voltage is not supplied to the terrestrial antenna port and hence the outdoor antenna. The main reason for this is that it is not desirable for voltage to reach a passive antenna. Voltage going to a passive antenna would distort the image. For this reason, there has never been a DC path mechanism in place for the terrestrial antenna port of a multi-switch.

There are negative aspects of not having a DC path mechanism to the terrestrial antenna port. Amplified outdoor antennas require the use of a power injector to supply DC voltage through the coaxial cable to the amplifier circuit, which is located in the antenna housing. As shown in FIG. 1, a consumer using an amplified outdoor antenna 118, requiring voltage for proper operation, and a conventional multi-switch 110, would need to place a power injector 120 between the antenna and the multi-switch. This would necessitate placing the power injector either outside or in an attic, since most cable junctions are located at those locations. These are not the most convenient or safest locations for electrically powered components.

Accordingly, there is a substantial interest in the industry for a Dual LNB multi-switch with a terrestrial antenna port that would allow a consumer to inject DC voltage from the power injector to the amplified antenna, while preventing this DC voltage from reaching a passive antenna.

SUMMARY OF THE INVENTION

It is an object of the present invention to provide a dual LNB/antenna multi-switch capable of delivering DC voltage to an amplified terrestrial outdoor antenna, requiring such voltage for its proper functioning.

It is another object of the present invention to provide a system utilizing a dual LNB/antenna multi-switch, where a power injector, necessary for injecting voltage into an amplified antenna, can be conveniently and safely placed indoors.

It is a further object of the present invention to provide a dual LNB/antenna multi-switch with a DC path to the terrestrial antenna port which can be safely used with a passive (non-amplified) antenna without distortion of a transmitted image.

Other objects, advantages and features of this invention will become more apparent hereinafter.

The solution that is subject of the present invention is a terrestrial DC path multi-switch. The new multi-switch will allow DC voltage provided by a satellite receiver to travel through the terrestrial antenna input without causing interference/distortion or lowering the signal strength of the satellite and terrestrial antenna pictures. By including an external DC block adapter with the invention, the multi-switch can be used with both amplified and non-amplified antennas. When using a non-amplified antenna, the external DC block adapter blocks the DC path in the antenna port eliminating any voltage from reaching the passive antenna. When using an amplified antenna, the power is provided by the satellite receiver.

BRIEF DESCRIPTION OF THE DRAWINGS

A full understanding of the invention can be gained from the following description of the preferred embodiment when read in conjunction with the accompanying drawings in which.

DETAILED DESCRIPTION OF THE PREFERRED EMBODIMENT AND THE DRAWINGS

Figure 1:
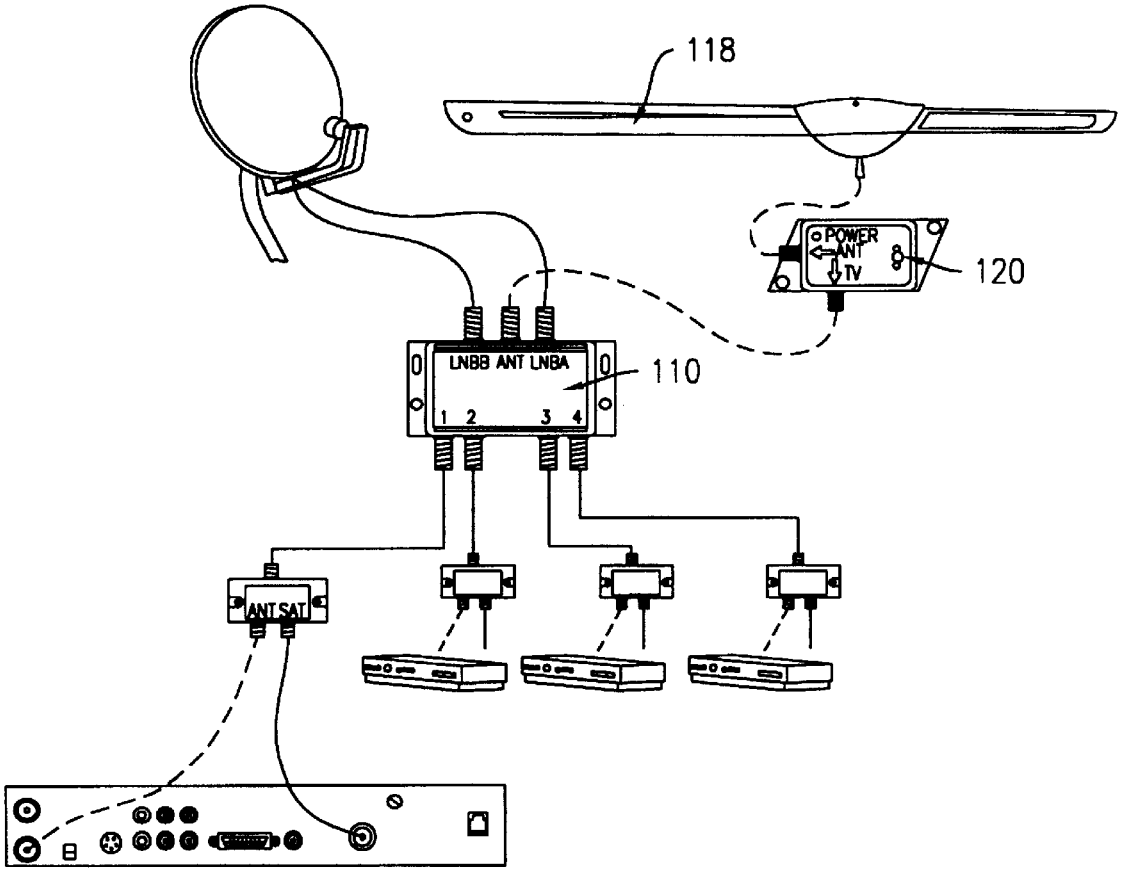
(PRIOR ART) FIG. 1
FIG. 1 is a schematic diagram of the prior art dual LNB mini-dish system with an amplified outdoor antenna used with a conventional multi-switch.
Figure 2:
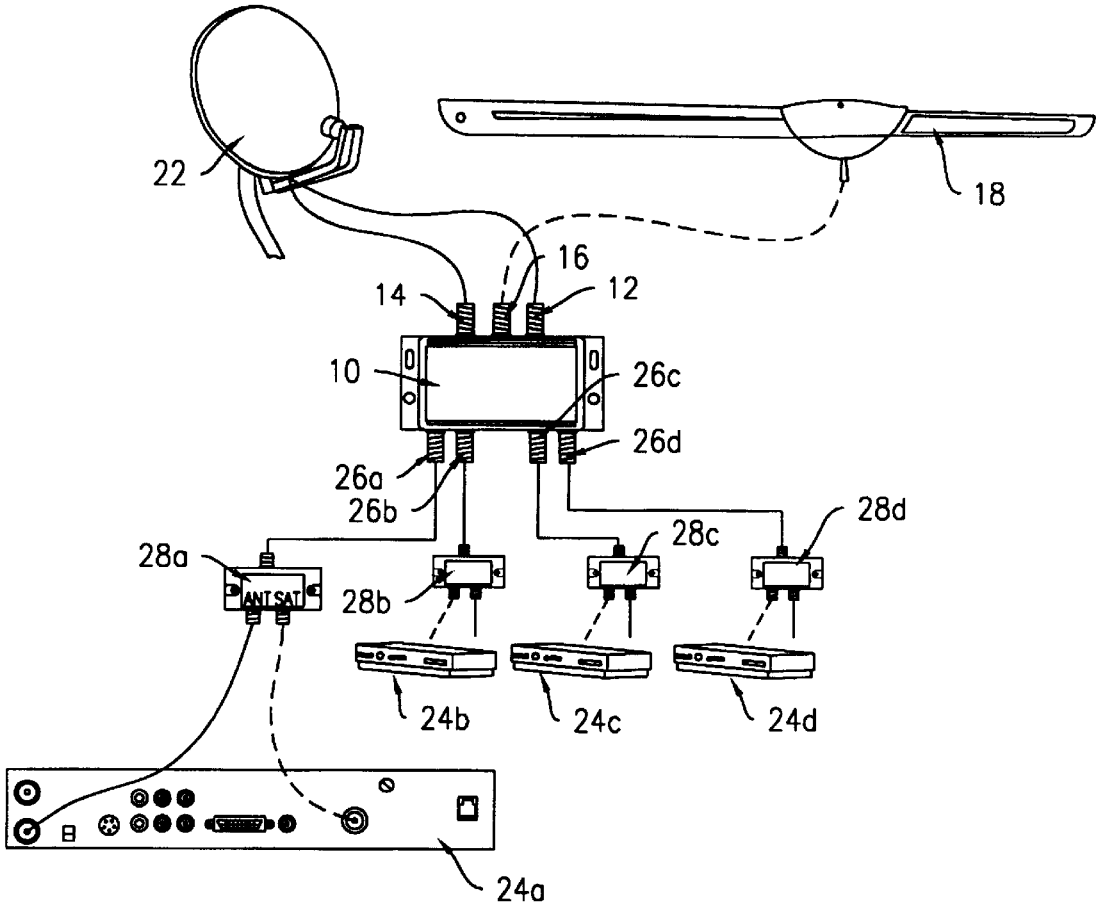
FIG. 2 is a schematic diagram of the dual LNB mini-dish system with an amplified outdoor antenna used with a multi-switch having a terrestrial DC path, in accordance with the present invention.

As shown in FIG. 2, a new multi-switch, generally designated with a reference number 10, has an A input side 12 rated at 13V/14V DC, a B input side 14 rated at 17V/18V DC and a terrestrial antenna port 16 with a DC voltage supplied to it. An outdoor terrestrial antenna 18 is directly connected to the port 16. A Dual Low Noise Block (LNB) mini-dish satellite antenna 22 is conventionally connected through digital coaxial cables to the A input 12 and the B input 14. It is a common practice in the industry to use an RG6 Digital 75 Ohm coaxial cable with a dual LNB mini-dish for this connection. The multi-switch 10 will combine the terrestrial antenna signals with the satellite signal and direct it to one of its outputs, for example 26*a*, for use with a single coaxial cable. To be used by a receiver 24*a* (shown as an enlarged back panel), the signal is then separated by a diplexer 28*a* and directed to an appropriate outlet of the receiver. As shown in FIG. 2, every room in a house may have its own receiver (24*a*, 24*b*, 24*c*, and 24*d*) with a corresponding diplexer (28*a*, 28*b*, 28*c*, and 28*d*), thereby allowing viewers to simultaneously see different programs in different rooms. Although the multi-switch is shown to have four outputs (26*a*, 26*b*, 26*c*, and 26*d*), it is designed to be used with any conventional number of receivers, typically ranging from four to eight.

When the multi-switch 10 is used with an amplified outdoor terrestrial antenna 18, as shown in FIG. 2, no separate power injector is needed to supply DC voltage through a coaxial cable to an amplifier circuit, located within the housing of the amplified antenna 18. Instead, the DC voltage signal sent by receiver 24 to control satellite antenna 22 is also used to power amplified antenna 18. antennas like TV 2000 or TV 3000, known in the industry, are preferred to be used with the present invention. However, any other amplified antenna known in the industry may be used with the new multi-switch provided they are compatible with satellite operation in the first place.

Because the multi-switch 10 has a DC power path, the power injector 20 may be placed between the receiver 24 and the multi-switch. When diplexers 28 are used with the invention, the power injector 20 is positioned between the diplexer and the receiver. This hookup makes the placement of the power injector more convenient, discrete and safe for a consumer. It may now be placed indoors behind the television for safe and easy access to the variable gain controls of the power injector.

An external DC block adapter (not shown) can be engaged with the antenna port 16. Thus, when a consumer is using a passive, non-amplified, antenna, the adapter selectively blocks the DC path, thereby eliminating any voltage from reaching the passive antenna. The DC block adapter used with the present invention is preferably the one manufactured by Jebsee Corp. under the name "70 Ohm DC Block," Model No. DB-1.

Having described this invention with regard to specific embodiments, it is to be understood that the description is not meant as a limitation since further variations or modifications may be apparent or may suggest themselves to those skilled in the art.

We claim as follows:

1. A dual LNB mini-dish system with an outdoor antenna comprising:

a multi-switch comprising (a) at least two satellite signal ports, (b) at least one terrestrial antenna port, (c) a DC voltage path connected to said terrestrial antenna port allowing DC voltage to travel up to said terrestrial antenna port, and (d) at least one output port;

a dual LNB mini-dish satellite antenna connected to said at least two satellite signal ports of said multi-switch and inputting a satellite signal into said multi-switch;

a terrestrial TV antenna connected to said at least one terrestrial antenna port and inputting a terrestrial antenna signal into said multi-switch;

at least one satellite receiver connected to said at least one output port of said multi-switch and capable of receiving a selected signal from said multi-switch, wherein said DC voltage path of said multi-switch enables a DC voltage signal from said satellite receiver to travel to said terrestrial TV antenna.

2. A dual LNB mini-dish system with an outdoor antenna according to claim 1, said terrestrial TV antenna including an amplified terrestrial TV antenna, wherein said DC voltage signal powers said amplified terrestrial TV antenna.

3. A dual LNB mini-dish system with an outdoor antenna according to claim 1, wherein said terrestrial antenna is a passive terrestrial antenna.

4. A dual LNB mini-dish system with an outdoor antenna according to claim 3, further comprising an external DC block adapter selectively connectable to said terrestrial antenna port and capable of preventing DC voltage from reaching said passive terrestrial antenna.

5. A dual LNB mini-dish system with an outdoor antenna according to claim 1 further comprising at least one diplexer placed into electrical connection between said at least one output port of said multi-switch and said at least one receiver for separating said satellite signal from said terrestrial antenna signal.

6. A dual LNB mini-dish system with an outdoor antenna according to claim 1 wherein said multi-switch further comprises a plurality of output ports.

7. A dual LNB mini-dish system with an outdoor antenna according to claim 6 further comprising a plurality of receivers, wherein each of said receivers is connected to its designated output port.

8. A dual LNB mini-dish system with an outdoor antenna according to claim 7 further comprising a plurality of diplexers, wherein each of said diplexers is connected to its designated output port and its designated receiver.

9. A multi-switch for use with a dual LNB mini-dish system and an outdoor terrestrial TV antenna comprising:

at least two satellite signal ports connectable to a dual LNB mini-dish satellite antenna;

at least one terrestrial TV antenna input port connectable to a terrestrial TV antenna; and a DC voltage path connected to said terrestrial antenna port allowing DC voltage to travel up to said terrestrial antenna input port;

at least one output port connectable to a satellite receiver capable of receiving a selected signal from said multi-switch, wherein said DC voltage path of said multi-switch enables a DC voltage signal generated by the satellite receiver intended for said satellite antenna to travel to said terrestrial TV antenna.

10. A multi-switch according to claim 9 further comprising an external DC block adapter connected to said terrestrial TV antenna input port for blocking DC voltage from reaching a passive terrestrial TV antenna that may be connected to said terrestrial TV antenna input port.

11. A multi-switch according to claim 9 further comprising a means for selecting an appropriate LNB.

12. A multi-switch according to claim 9 further comprising a means for routing an inputted signal to its designated receiver.

* * * * *